US006786777B2

(12) United States Patent
Sakatani

(10) Patent No.: US 6,786,777 B2
(45) Date of Patent: Sep. 7, 2004

(54) SPLIT-TYPE CONNECTOR

(75) Inventor: Atsushi Sakatani, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/448,813

(22) Filed: May 29, 2003

(65) Prior Publication Data

US 2003/0236032 A1 Dec. 25, 2003

(30) Foreign Application Priority Data

May 29, 2002 (JP) ..... 2002-154959

(51) Int. Cl.[7] ..... H01R 13/64
(52) U.S. Cl. ..... 439/677
(58) Field of Search ..... 439/677, 678, 439/680, 701

(56) References Cited

U.S. PATENT DOCUMENTS 3,399,374 A * 8/1968 Pauza et al. ..... 439/355
4,997,386 A * 3/1991 Kawachi et al. ..... 439/352
5,328,288 A 7/1994 Masuda ..... 403/329
5,529,426 A 6/1996 Masuda et al. ..... 403/329
6,132,246 A * 10/2000 Kodama ..... 439/557
6,638,108 B2 * 10/2003 Tachi ..... 439/595

* cited by examiner

*Primary Examiner*—Tulsidas C. Patel
(74) *Attorney, Agent, or Firm*—Gerald E. Hespos; Anthony J. Casella

(57) ABSTRACT

A frame (10) has accommodating chambers (18) and auxiliary housings (30) are inserted into the accommodating chambers (18) from behind. An identifying portion (33) is formed at a side surface of the rear end of each auxiliary housing (30). The identifying portions (33) are aligned vertically along a side edge (10R) of the rear surface of the frame (10) if all auxiliary housings (30) are inserted properly. The identifying portion (33) of an improperly inserted auxiliary housing (30) is at the wrong side, and can be detected. There is no need to make a vertical interval between accommodating chambers (18) larger because the identifying portions (33) are at sides of the auxiliary housings (30). Thus, the height of the frame (10) can be reduced.

8 Claims, 11 Drawing Sheets

SPLIT-TYPE CONNECTOR

BACKGROUND OF THE INVENTION

1. Field of the Invention

The invention relates to a split-type connector that accommodates auxiliary housings in a frame and to a method of assembling such a connector.

2. Description of the Related Art

U.S. Pat. No. 5,328,288, U.S. Pat. No. 5,529,426 reference to FIG. 11 a split-type joint connector has a frame 1 and a plurality of accommodating chambers 2 arranged at several stages in the frame 1. An auxiliary housing 3 is accommodated in each accommodating chamber 2, and terminal fittings are accommodated in each auxiliary housing 3. This connector is used to join the terminal fittings of the respective stages along each vertical line by utilizing, for example, busbars at the back side of the frame 1.

However, partition walls for partitioning the accommodating chambers 2 must be made thicker to form the guide grooves. As a result, the height of the frame and the height of the entire connector become larger. Thus, there has been a demand for a further improvement.

The present invention was developed in view of the above problem and an object thereof is to provide a function of detecting an upside-down insertion while having a reduced height of the split-type connector.

SUMMARY OF THE INVENTION

The invention is directed a split-type connector comprising a frame with one or more accommodating chambers into each of which an auxiliary housing is insertable. An identifying portion is formed at a rear end of each auxiliary housing with respect to its inserting direction and at a side surface thereof along an arranging direction of the auxiliary housings. The identifying portions are brought into a specified arrangement when the respective auxiliary housings are accommodated properly.

The identifying portions are at the rear of the frame when the auxiliary housings are inserted into the accommodating chambers. The auxiliary housings can be inserted properly if the identifying portions take the specified arrangement. However, an erroneous orientation can be detected if an auxiliary housing cannot be inserted properly.

Proper insertion of the auxiliary housings can be judged easily and precisely by seeing the arrangement of the identifying portions. Further, the identifying portions are at the side surfaces of the auxiliary housings extending substantially along the arranging direction of the auxiliary housings. Thus, there is no need to make an interval between the accommodating chambers larger and the size of the frame or the connector can be kept small.

The frame preferably is formed with a mark at a position corresponding to an aligned position of the respective identifying portions.

The auxiliary housings can be held automatically in their proper postures by being inserted into the accommodating chambers while locating the identifying portions in conformity with the mark formed on the frame.

Each identifying portion preferably is a projection projecting from the side surface of the corresponding auxiliary housing.

The projections are at the rear surface of the connector. Thus, proper insertion of the auxiliary housings can be detected, for example, by preparing a jig formed with a recess in conformity with the arrangement of the projections and bringing the jig into contact with the rear surface of the connector.

A rear surface of the auxiliary housings, as seen in the inserting direction, preferably is substantially flush with the rear surface of the frame, and preferably flush with the rear surface of a cavity tower on the frame.

A height of the identifying portion preferably is set so as not to bulge out from the lateral side surface of the frame.

The invention also relates to a method of mounting a split-type connector. The method comprises providing a frame having one or more accommodating chambers, and then inserting auxiliary housings into the respective accommodating chambers. An identifying portion is formed on each auxiliary housing at a rear end side thereof with respect to its inserting direction and at a side surface thereof along an arranging direction of the auxiliary housings. The method then comprises bringing the respective identifying portions into a specified arrangement when the respective auxiliary housings are accommodated properly.

The method may further comprise a step of mounting a tool to the frame for detecting the proper orientation of the auxiliary housings. Thus, at least one of the identifying portions will generate interference in case of improper arrangement of at least one auxiliary housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
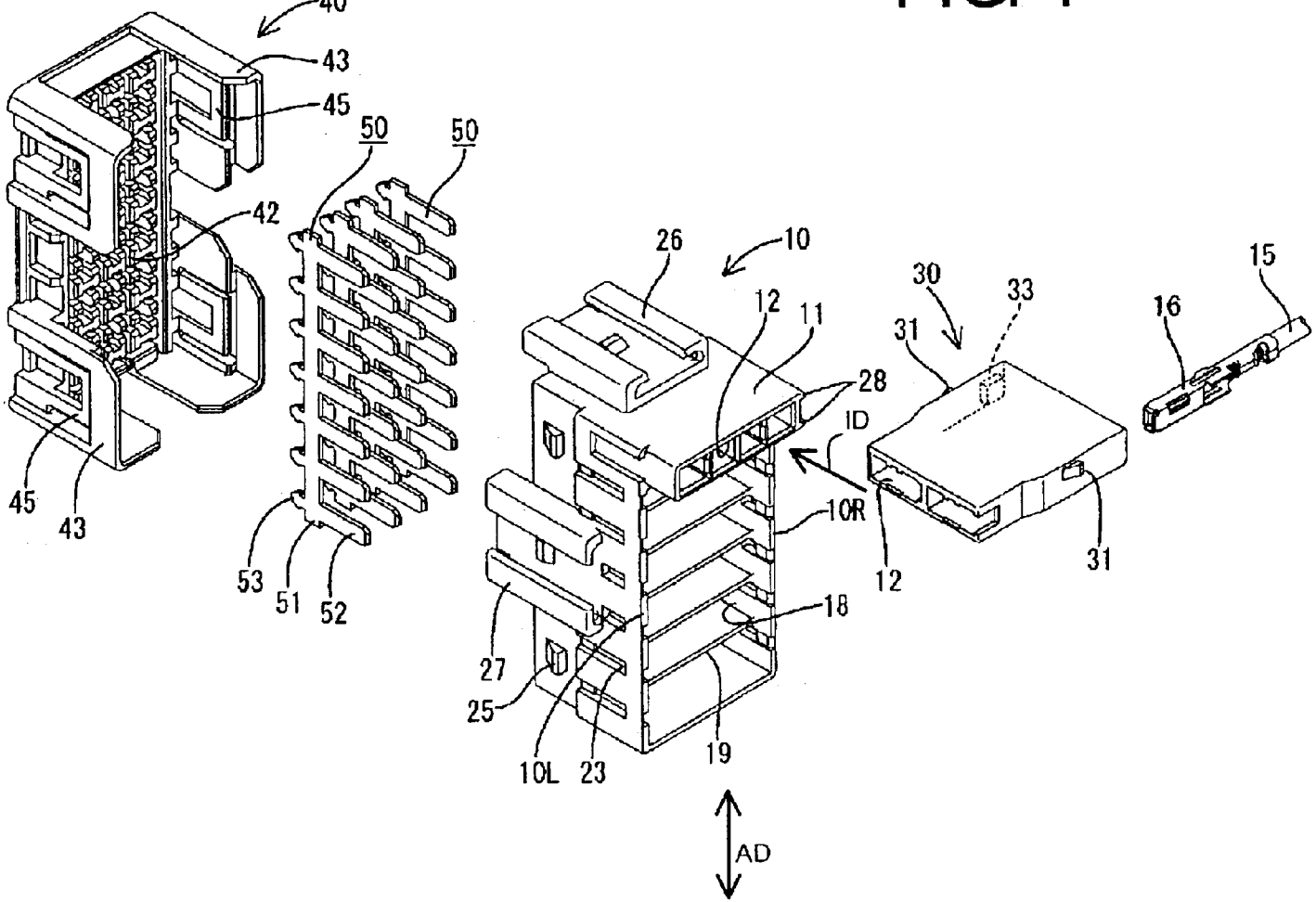
FIG. 1 is an exploded perspective view of a split-type connector according to one embodiment of the present invention.
Figure 2:
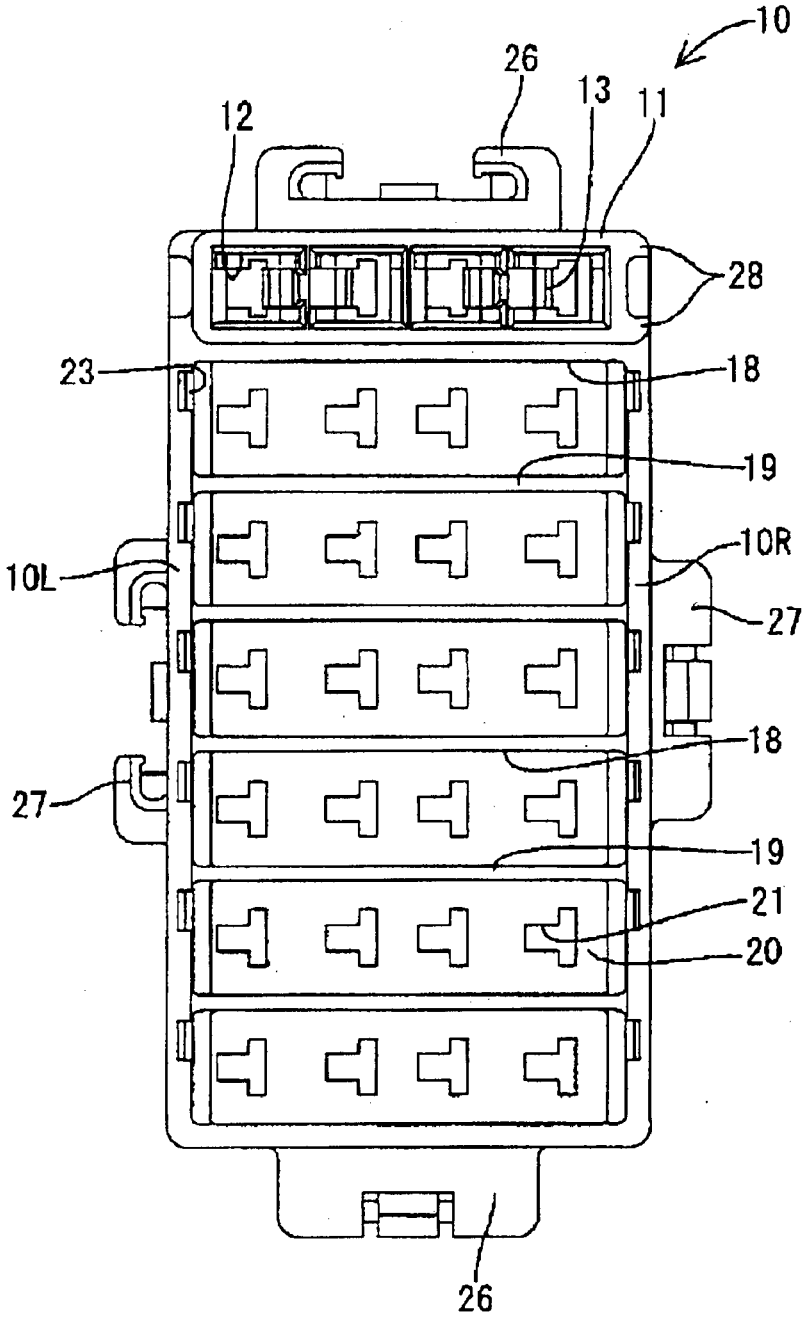
FIG. 2 is a rear view of a frame.
Figure 3:
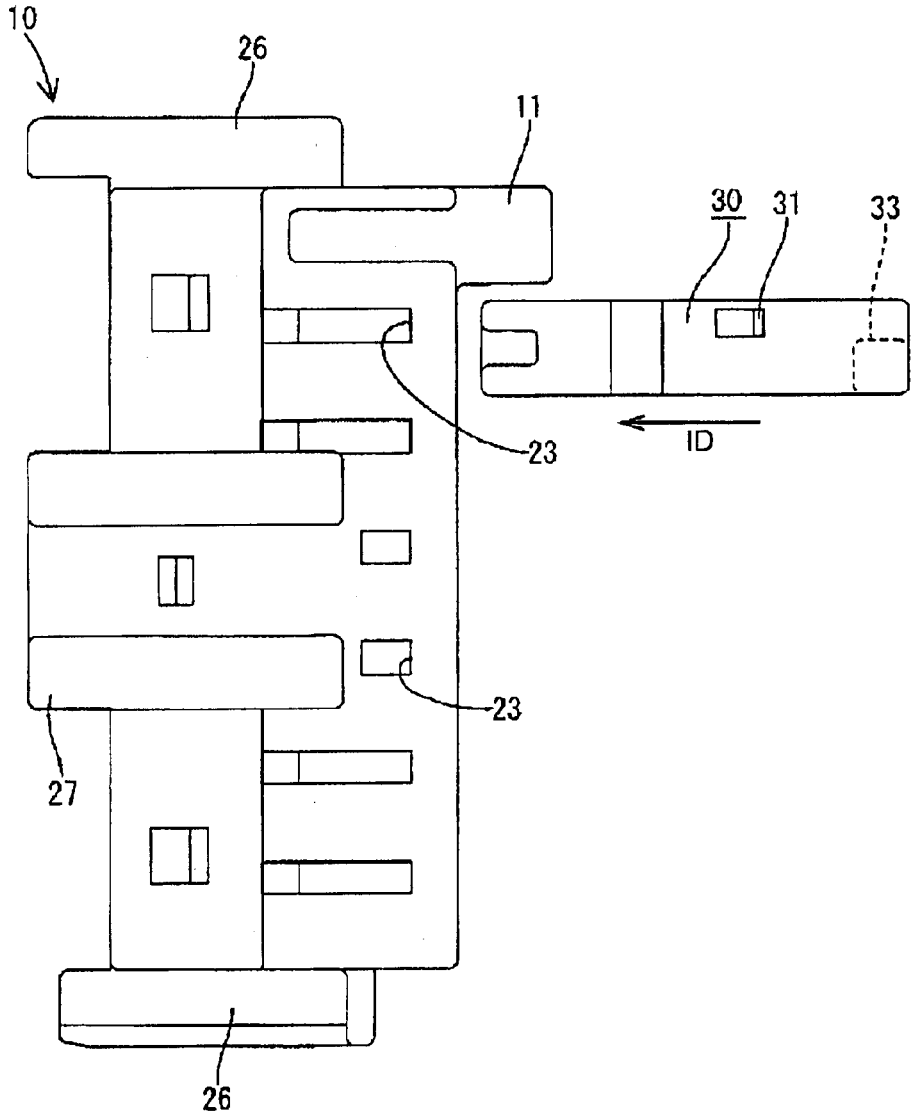
FIG. 3 is a side view showing an insertion of an auxiliary housing.

A split-type joint connector according to the invention is illustrated in FIGS. 1 to 10 and includes a frame 10 formed e.g. of a synthetic resin. The frame 10 is a substantially vertically long block divided into seven stages along a vertical arranging direction AD, as shown in FIGS. 2 and 3. A cavity tower 11 is formed at an uppermost stage and projects backward. Four cavities 12 are arranged laterally in the cavity tower 11 and extend in forward and backward directions. A terminal fitting 16 (see FIG. 1) is crimped, bent or folded into connection with an end of a wire 15 and is inserted into each cavity 12 from behind along an inserting direction ID. A lock 13 in the cavity 12 locks the terminal fitting 16 so as not to come out.

An area of the frame 10 below the cavity tower 11 is divided into six stages of wide accommodating chambers 18 by partition walls 19. Each accommodating chamber 18 has an open rear end, which is more forward than the rear of the cavity tower 11 by a specified distance. Four insertion openings 21 are formed substantially side-by-side in a front wall 20 of each accommodating chamber 18.

Figure 4:
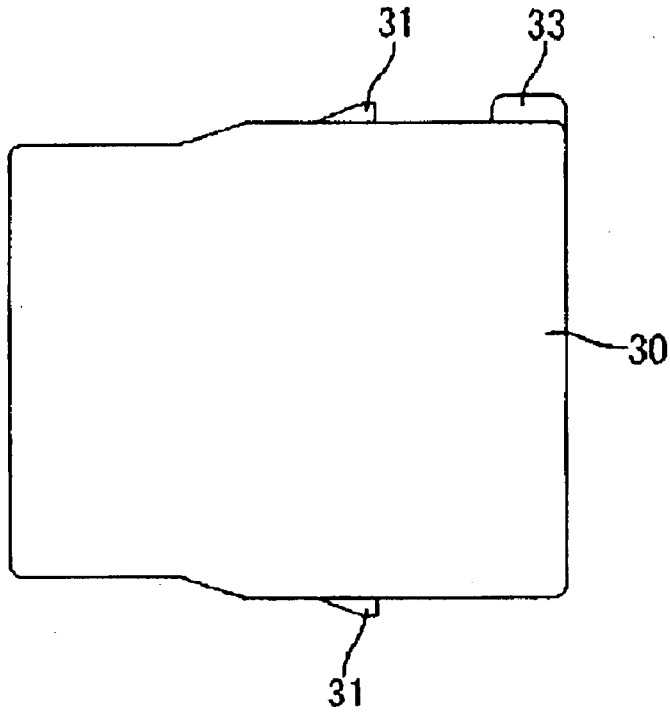
FIG. 4 is a plan view of the auxiliary housing.
Figure 5:
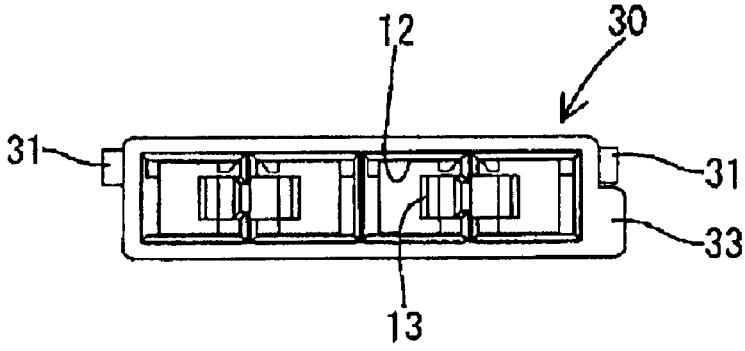
FIG. 5 is a rear view of the auxiliary housing.

Auxiliary housings 30 are inserted in an inserting direction ID into the corresponding accommodating chambers 18. Accordingly, the auxiliary housings 30 are arranged vertically along the arranging direction AD with respect to each other. Each auxiliary housing 30 is formed e.g. of a synthetic resin and is substantially a flat block, as shown in FIGS. 3 to 5. Most of the front side of each auxiliary housing 30 fits closely into the corresponding accommodating chamber 18. Four cavities 12 are arranged laterally in each auxiliary housing 30 and extend forward and back. The terminal fittings 16 are inserted into each cavity 12 from behind along an inserting direction and locks 13 in each cavity 12 lock the terminal fittings 16 so as not to come out.

Engaging projections 31 project at upper ends of the opposite side surfaces of each auxiliary housing 30, whereas engaging grooves 23 are formed in side walls of each accommodating chamber 18. Each auxiliary housing 30 is inserted from behind into the corresponding accommodating chamber 18 along the inserting direction ID, as indicated by an arrow in FIG. 3, and is pushed in the inserting direction ID to a proper position where it contacts the front wall 20. The auxiliary housing 30 is locked in the proper position by engagement of the engaging projections 31 with the engaging grooves 23. At this time, the rear surface of the auxiliary housing 30 is substantially flush with the rear end of the cavity tower 11 (see FIG. 10(A)).

The connector further includes a cover 40 formed e.g. of a synthetic resin. The cover 40 is substantially in the form of a thick plate that substantially covers the front surface of the frame 10. Four busbars 50 are mounted in the back surface of the cover 40, which is the surface at the front side of FIG. 1.

Figure 8:
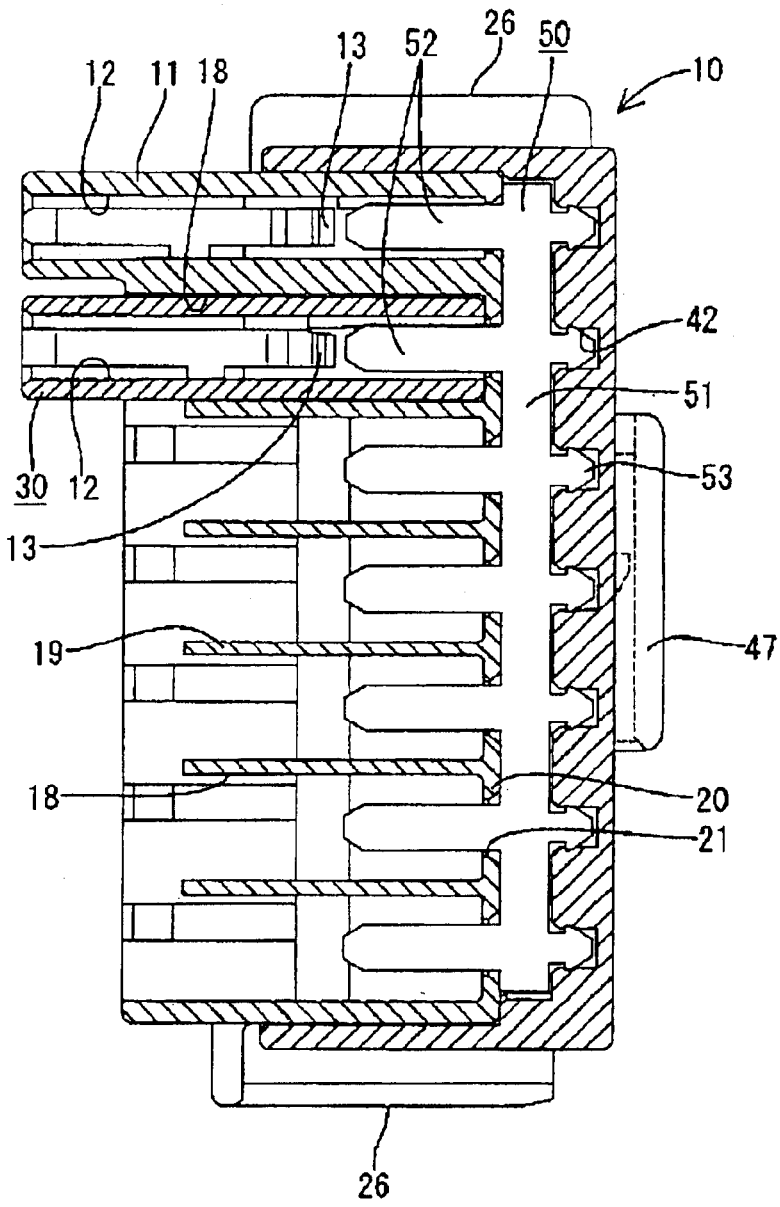
FIG. 8 is a section showing a state where a cover is mounted.

Each busbar 50 has seven tabs 52 that project from a vertical bar 51 at specified intervals. As shown in FIG. 8, each busbar 50 is mounted to the cover 40 by pressing press-in pieces 53 projecting at a side of the vertical bar 51 opposite from the tabs 52 into corresponding press-in grooves 42 in the cover 40.

The busbars 50 are arranged transversely in four lines corresponding to the four laterally arranged terminal fittings 16. Further, the tabs 52 of each busbar 50 project at positions corresponding to the respective stages of the frame 10.

Covering portions 43 project at four corners of the back surface of the cover 40 for substantially covering corners at the front side of the frame 10. A locking piece 45 on each covering portion 43 is engageable with a locking projection 25 near the corresponding corner at the front side of the frame 10.

The cover 40 is brought into contact with the front mating surface of the frame 10 so that the covering portions 43 cover the corners of the frame 10. The cover 40 then is secured by engaging the respective locking pieces 45 with the locking projections 25. At this time, the tabs 52 of the busbars 50 project into the corresponding cavities 12 from the front as shown in FIG. 8.

Coupling portions 26 and 27 are formed at upper, lower, left and right surfaces of the frame 10 to couple a plurality of the frames 10. A bracket 47 on the front surface of the cover 40 for connection with a mating member.

Figure 6:
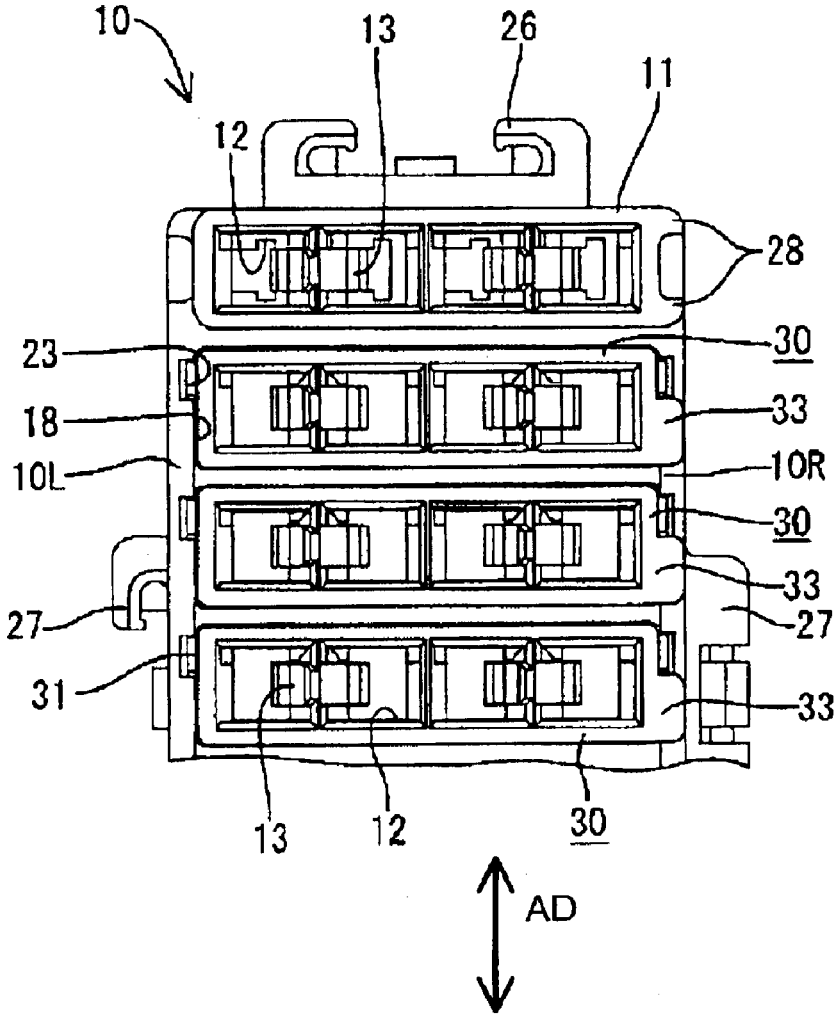
FIG. 6 is a fragmentary rear view showing a state where the auxiliary housings are properly inserted.

An identifying portion 33 is formed on each auxiliary housing 30 for detecting an upside-down or improper insertion. The identifying portion 33, as shown in FIGS. 4 and 5, is raised slightly in a specified shape (e.g. a substantially rectangular shape) at a lower portion of the rear end of the right side surface of the auxiliary housing 30 when viewed from behind. As shown in FIG. 6, the height of the identifying portion 33 is set so as not to bulge out from the right side surface of the frame 10 when viewed from behind when the auxiliary housing 30 is inserted properly into the corresponding accommodating chamber 18, as described later.

A mark 28, preferably in the form of a forked rib, is formed at the right end of the rear surface of the cavity tower 11 when viewed from behind, and hence is at the same side as the identifying portions 33.

A first of the auxiliary housings 30 with the terminal fittings 16 therein is inserted from behind into the corresponding accommodating chamber 18 of the frame 10 along the inserting direction ID. More particularly, the auxiliary housing 30 is inserted so that the identifying portion 33 is at the right side when viewed from behind and hence conforms with the mark 28 on the cavity tower 11. The auxiliary housing 30 is pushed to a proper position, and hence will not come out, as described above. In the same way, the remaining auxiliary housings 30 are accommodated into the corresponding accommodating chambers 18 at the respective stages along the arrangement direction AD.

The rear side of the frame 10 is inspected as a precaution after all of the auxiliary housings 30 are inserted. If all the auxiliary housings 30 are inserted properly, the identifying portions 33 of the respective auxiliary housings 30 are aligned along the right side edge 10R of the rear surface of the frame 10, as shown in FIG. 6. Observation of such a state confirms that all of the auxiliary housings 30 have been inserted properly.

Figure 7:
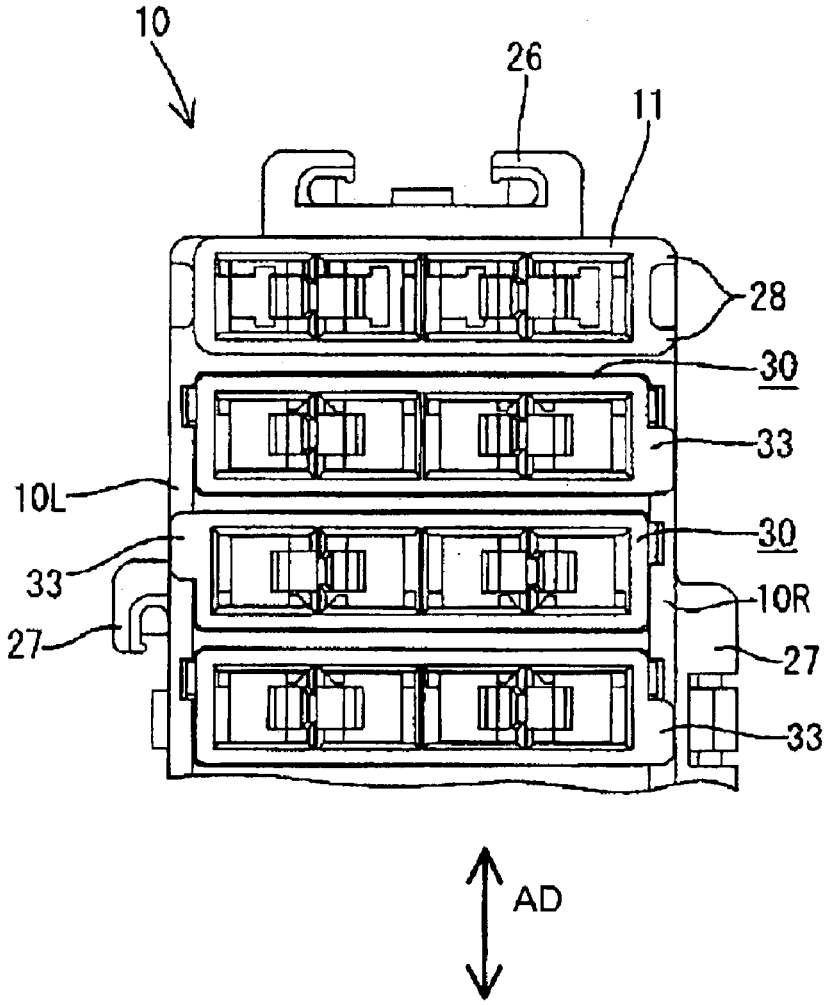
FIG. 7 is a fragmentary rear view showing a case of an erroneous insertion of the auxiliary housing.

On the other hand, an auxiliary housing 30 may be inserted improperly, e.g. upside down. Hence, the identifying portion 33 of this auxiliary housing 30 is at the left side as shown in FIG. 7, and an erroneous insertion can be detected easily. This auxiliary housing 30 then may be withdrawn and inserted again in a proper posture.

The terminal fittings 16 are inserted into the cavities 12 of the cavity tower 11 after proper insertion of the auxiliary housings 30 is confirmed.

Finally, the cover 40 having the busbars 50 mounted therein is mounted on the front mating surface of the frame 10. Thus, the tabs 52 of the respective busbars 50 enter the corresponding cavities 12 from the front and connect with the terminal fittings 16 therein, as shown in FIG. 8.

In this way, four lines of the terminal fittings 16 vertically arranged at the seven stages, are connected via the busbars 50 for the respective vertical lines.

Figure 9:
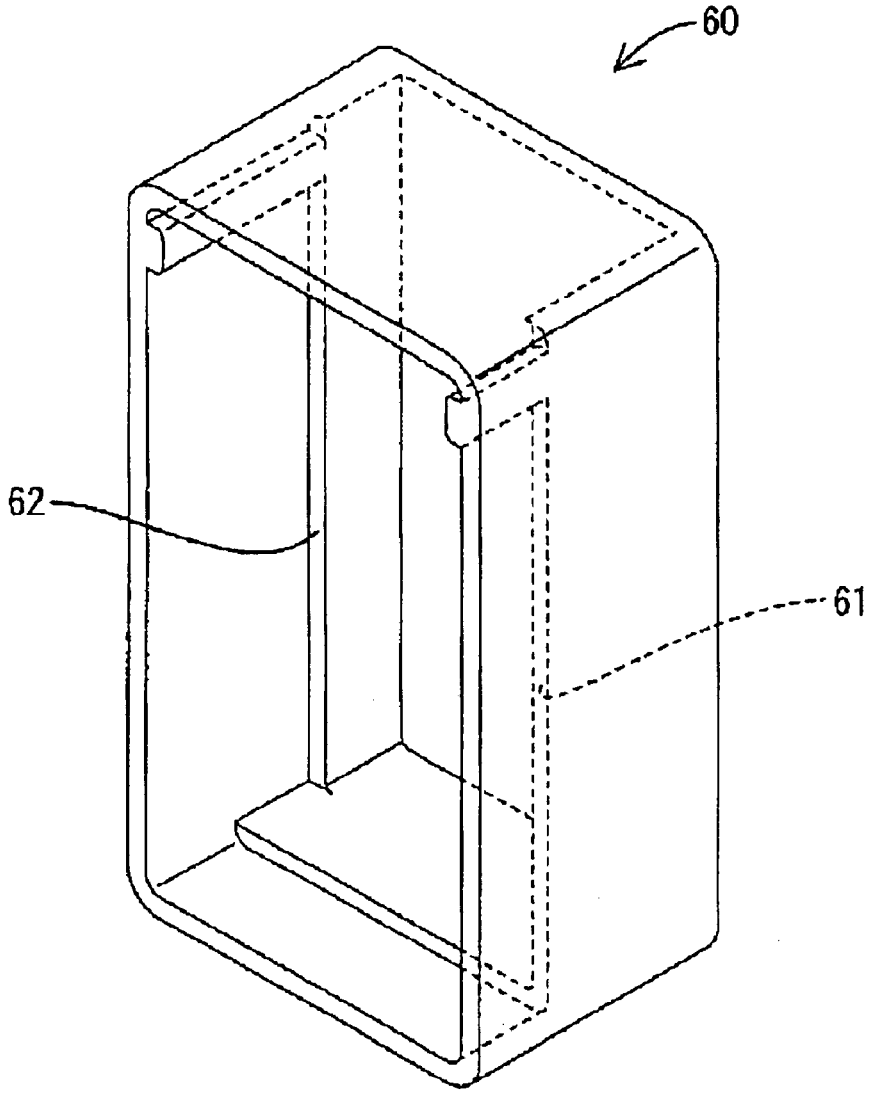
FIG. 9 is a perspective view of a jig.

Proper insertion of the auxiliary housing 30 may be detected by a jig. More particularly, a detecting jig 60, as shown in FIG. 9, is formed into a tubular shape fittable around the outer circumferential surface of the rear side of the frame 10. The front side of FIG. 9 is the front end with respect to a fitting direction of the jig 60.

First and second detecting surfaces 61 and 62 are formed at the left and right inner walls of the jig 60, and are receded from the front end at positions corresponding to left and right side edges 10L, 10R of the rear surface of the frame 10. More specifically, the first detecting surface 61 at the left side is receded slightly and contacts the left side edge 10L of the frame 10, which is the side of the frame 10 with no identifying portions 33 and no the marks 28 when the auxiliary housings 30 are arranged properly. The jig 60 is fit to the frame 10 and reaches a proper position where the front end of the jig 60 contacts the coupling portions 26, 27. The second detecting surface 62 at the right side is receded deeply and contacts the mark 28 at the right portion of the cavity tower 11 when the jig 60 is fitted to the proper position. The identifying portion 33 on the auxiliary housing 30 comes to a position flush with the mark 28 of the cavity tower 11 when the auxiliary housing 30 is inserted properly into the accommodating chamber 18, and hence the second detecting surface 62 contacts both the identifying portion 33 and the mark 28.

Figure 10A:
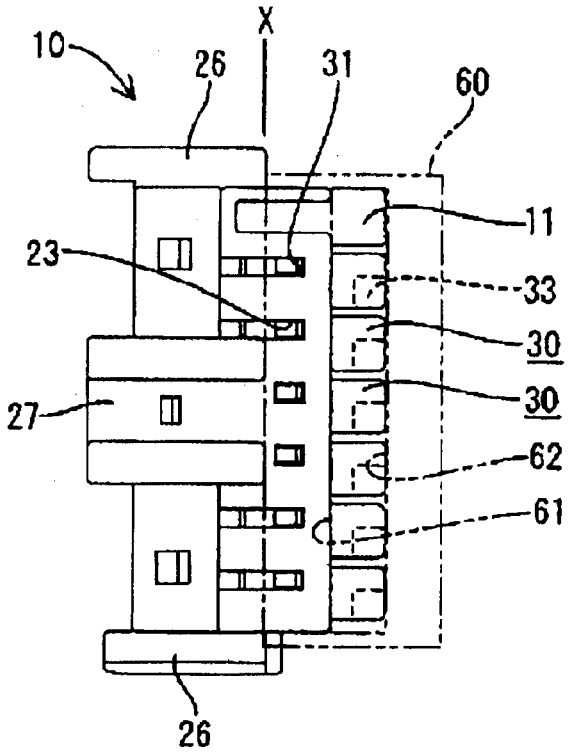
FIG. 10 is a side view showing a detection by means of the jig.

The jig 60 is fitted onto the rear outer peripheral surface of the frame 10 after all the auxiliary housings 30 are inserted into the chambers 18. If all the auxiliary housings 30 are inserted properly, the identifying portions 33 of the respective auxiliary housings 30 are aligned along the right side edge 10R of the frame 10 as shown in FIG. 6. Thus, as shown in FIG. 10(A), the jig 60 can be fitted to a proper position X so that the first detecting surface 61 contacts the left side edge 10L of the frame 10 and the second detecting surface 62 contacts the mark 28 and the identifying portions 33.

Figure 10B:
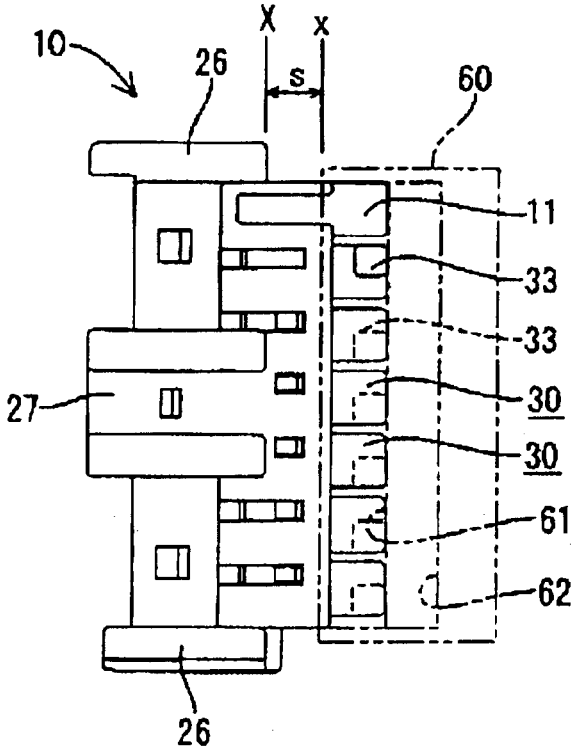
Figure 11:
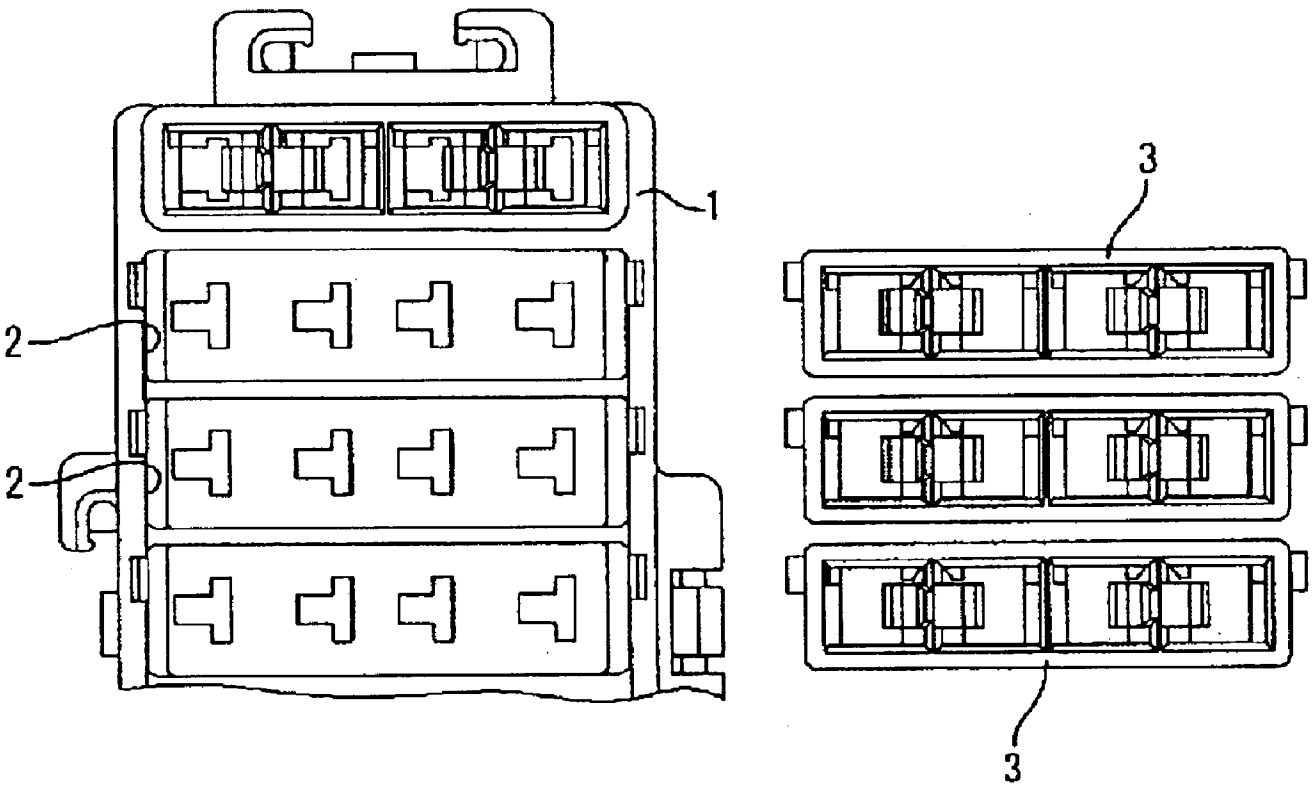
FIG. 11 is a rear view of a prior art split-type connector.
Figure 12:
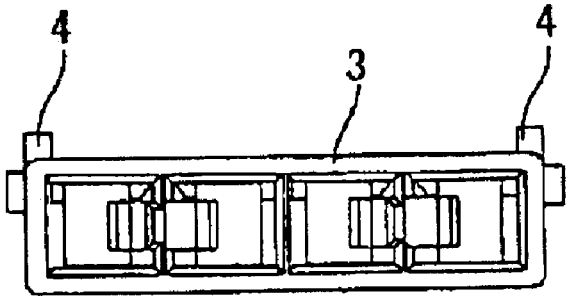
FIG. 12 is a rear view of an auxiliary housing as a countermeasure against a problem of the prior art split-type connector.

The identifying portion 33 of an auxiliary housing 30 that is inserted upside down or incorrectly is at the left side and bulges out into the left side edge 10L of the frame 10. Thus, as shown in FIG. 10(B), the first detecting surface 61 contacts this bulging identifying portion 33 earlier, so that the jig 60 can be pressed only up to a position "x" located more forward than the proper position X by a distance "s". As a result, an erroneous insertion is detected.

As described above, proper insertion of the auxiliary housings 30 can be judged easily and precisely judged by seeing or sensing whether the identifying portions 33 are aligned. Further, the identifying portions 33 are at the widthwise ends of the auxiliary housings 30. Hence, there is no need to make the interval between the accommodating chambers 18 larger, for example, by thickening the partition walls 19. As a result, the height of the frame or the connector can be reduced.

The mark 28 is provided on the cavity tower 11 of the frame 10. Thus, the auxiliary housings 30 can be held automatically in their proper postures by being inserted into the corresponding accommodating chamber 18 while locating the identifying portion 33 in conformity with the mark 28.

Further, proper insertion of the auxiliary housing 30 is inserted can be detected both visually and also by utilizing the jig or tool 60.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The proper arrangement of the identifying portions is not limited to the one vertical line illustrated in the foregoing embodiment, and any desired arrangement such as a zigzag arrangement may be selected.

The form of the identifying portion is not limited to the form of a projection and may be in the form of a recess.

A jig used for assembling the frame and the cover may serve also as the jig for detecting whether the auxiliary housings are properly inserted.

It is not always necessary to provide the frame with the mark for aligning the identifying portions and such a connector provided with no mark is also embraced by the technical scope of the present invention.

The present invention is not limited to the joint connector and is applicable to usual wire-to-wire connectors and to all split-type connectors in which a plurality of auxiliary housings are accommodated in a frame.

What is claimed is:

1. A split-type connector comprising a frame with accommodating chambersarranged along an arranging direction, auxiliary housings having opposite front and rear ends and opposite first and second sides extending between the front and rear ends, the front ends of the auxiliary housings being insertable into the respective accommodating chambers along an inserting direction, an identifying portion (33) being formed on each auxiliary housing (30) at the rear end thereof with respect to the inserting direction (ID) and at the first side thereof, the second side of each auxiliary housing having no identifying portion, wherein the respective identifying portions are substantially aligned when the respective auxiliary housings are accommodated properly in the accommodating chambers.

2. The split-type connector of claim 1, wherein a mark is formed on the frame at a position corresponding to an arranging position of the respective identifying portions (33) when the auxiliary housings are inserted properly.

3. The split-type connector of claim 1, wherein the identifying portion is a projection projecting from the auxiliary housing.

4. The split-type connector of claim 1, wherein rear surfaces of the auxiliary housings as seen in the inserting direction are substantially flush with a rear surface of the frame.

5. The split-type connector according of claim 1, wherein a height of the identifying portion is so set as not to bulge out from side surfaces of the frame.

6. A method of mounting a split-type connector, providing a frame having accommodating chambers;

providing auxiliary housings configured for insertion into the accommodating chambers in an inserting direction and in at least one rotational orientation, each said auxiliary housing having an identifying portion at a rear end side of the auxiliary housing with respect to its inserting direction and at a side surface of the auxiliary housing;

inserting auxiliary housings into the respective accommodating chambers along the inserting direction; and comparing alignment of the identifying portions with a specified arrangement for detecting whether the respective auxiliary housings are accommodated properly, wherein the step of comparing alignment comprises mounting a tool to the frame to detect orientations of the auxiliary housings.

7. The method of claim 6, wherein the respective identifying portions are aligned at one side with respect to a direction substantially normal to the arranging direction of the auxiliary housings when the respective auxiliary housings are accommodated properly.

8. The method of claim 7, wherein a mark is formed on the frame at a position corresponding to an arranging position of the respective identifying portions.

* * * * *